United States Patent [19]

Tisma

[11] Patent Number: 4,856,566

[45] Date of Patent: Aug. 15, 1989

[54] FAST ACTING LOADING SYSTEM FOR AUTOMATIC PACKAGING MACHINE

[75] Inventor: Steven Tisma, Chicago, Ill.

[73] Assignee: Tisma Machine Corporation, Chicago, Ill.

[21] Appl. No.: 164,010

[22] Filed: Mar. 4, 1988

[51] Int. Cl.[4] ..... B65B 57/04

[52] U.S. Cl. ..... 141/142; 141/140; 141/141; 141/170; 141/177

[58] Field of Search ..... 141/140, 141, 142, 143, 141/163, 168, 134, 135, 156, 138, 177, 129, , 144, 145, 170

[56] References Cited

U.S. PATENT DOCUMENTS

| | | | |
|---|---|---|---|
| 1,666,931 | 5/1928 | Hansen | 141/105 |
| 2,910,212 | 10/1959 | Kerr | 141/145 |
| 4,514,954 | 5/1985 | Anderson et al. | 141/140 |

FOREIGN PATENT DOCUMENTS

| | | | |
|---|---|---|---|
| 735492 | 5/1980 | U.S.S.R. | 141/83 |

*Primary Examiner*—Henry J. Recla
*Assistant Examiner*—Edward Donovan
*Attorney, Agent, or Firm*—Laff, Whitesel, Conte & Saret

[57] ABSTRACT

The invention greatly increases the speed at which a fill step may be completed in an automatic packaging machine. Instead of the usual process where a gate opens and closes for dumping product into each empty box, a plurality of bottomless measuring cups and transfer cups are moved in an aligned sequence with the corresponding boxes. These cups move over planar surfaces which function as the bottoms of the cups and keep the product in place within the cups. At selected locations, the cups pass over interruptions in the surfaces so that the product may fall out of the cup and into an underlying structure. The sequence is (a) measure product in a measuring cup, (b) drop the product from the measuring cup into a transfer cup, (c) deflect the path of the transfer cup is a box into which it would transfer its product is missing, (d) dump product form any non-deflected transfer cup into a corresponding box, (e) recover product from any deflected transfer cup, and (f) return the deflected transfer cup to a normal path after recovery of its products. The parts are arranged to greatly reduce set up time by making it easy to replace or exchange cups, to fill different sizes of boxes, for example.

20 Claims, 5 Drawing Sheets

FILLING STATION 33

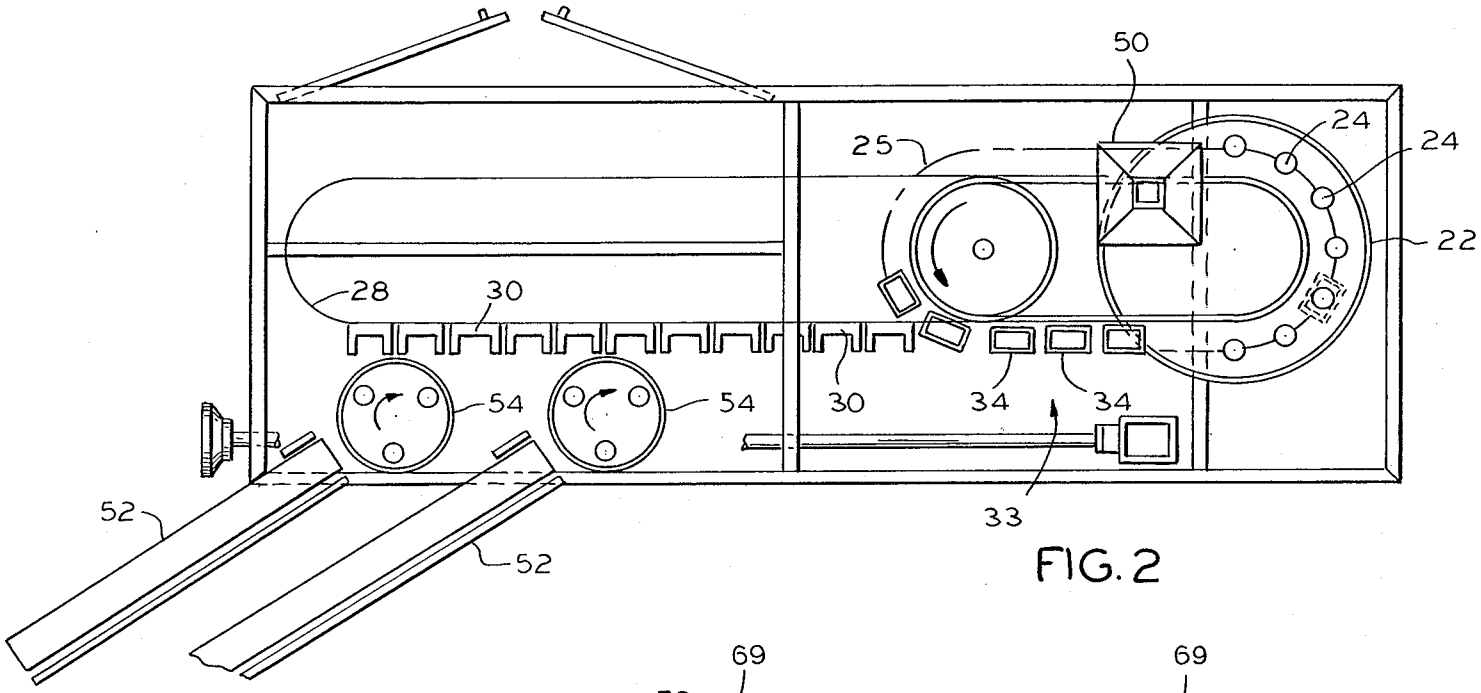
FIG. 2
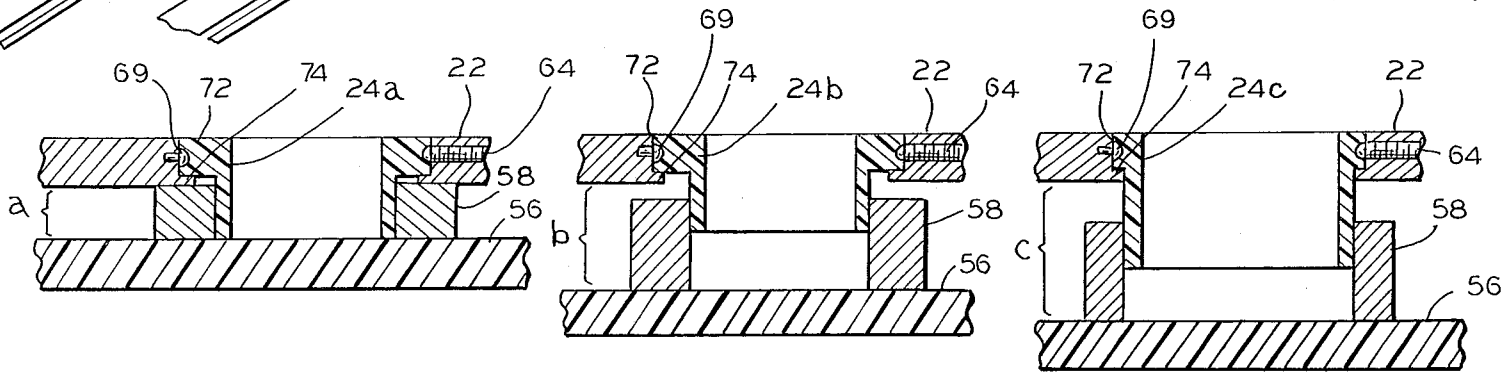
FIG. 3C
FIG. 3B
FIG. 3A

FAST ACTING LOADING SYSTEM FOR AUTOMATIC PACKAGING MACHINE

This invention relates to loading stations for automatic packaging machines and more particularly to fast acting loading stations with greatly reduced wear.

Automatic packaging machines usually have a magazine filled with cardboard blanks which are picked up, one at a time, by vacuum cups, formed into boxes, and inserted into individual mandrels. The mandrels are carried by an endless chain which circles a table. As the mandrels pass various work stations, the boxes are filled with product, closed, sealed, and discharged. The mandrels circle back to receive the next empty boxes, after the filled boxes are discharged.

A common problem is that occasionally a box either is missing or is not properly inserted into a mandrel. Then, it becomes necessary to detect the empty or improperly filled mandrel and to abort the fill cycle when that particular mandrel appears at the fill station. Otherwise, the product would be dumped through the empty mandrel and, perhaps, onto whatever is beneath it. Aside from any damage caused by the product falling into machinery, if the product may spoil, as with a food, the resulting unsanitary condition would be intolerable.

Heretofore, automatic packaging machines have included a series of measuring cups for carrying product to boxes at a fill station. A detector detected the presence of each box as its associated measuring cup approaches a mandrel. If the box is present, a gate in the bottom of the measuring cup is opened to dump the contents of the cup into the box. The gate is not opened if the box is missing. The operation of a gate on each fill cycle requires some finite time which inherently limits the speed of the packaging machine. The continuous operation of a gate on each and every fill cycle imposes substantial wear and, therefore, a high maintenance cost.

Therefore, an object of the invention is to provide new and improved automatic packaging machines with greatly increased fill speed. Here, an object is to provide packaging machines which do not require gates for transferring product from a cup to a box.

Another object is to provide automatic packaging machines which can recover product that is not dumped into boxes.

Still another object of the invention is to provide wear resistant moving parts at fill stations.

Yet another object of the invention is to provide automatic packaging machines which may be changed over quickly and easily when it is necessary to change the volume of product which is placed in each box.

In keeping with an aspect of the invention, these and objects are accomplished by providing an endlessly circling series of bottomless transfer cups, each cup being made of a highly wear resistant material, such as molded nylon. These cups slide along a first wear resistant surface which functions as the bottom of the cups, to retain any product therein. A series of box carrying mandrels move under the first surface, in synchronism and alignment with the transfer cups. At a given location, the first surface has a first interruption so that any product within the transfer cup falls into a box carried by the mandrel. If an empty mandrel is detected, the transfer cup is deflected from its normal path so that it does not pass over the first interruption, which prevents the product from falling out of the cup. Instead, the deflected transfer cup passes over a second interruption in the surface through which the product falls, to enter a recovery bin. A number of bottomless measuring cups are positioned in a merry-go-round which is above the transfer cups in order to deposit a predetermined volume of product in each transfer cup, when the measuring cup encounters a second interruption in a second surface that functions as the bottom of the measuring cup. To change the volume of product deposited in each box, the measuring cups may be replaced quickly and easily, without requiring any substantial amount of work for disassembly and reassembly of the packaging machines.

A preferred embodiment of the invention is shown in the attached drawings, in which:

FIG. 2 is a plan view looking down on the top of the machine of FIG. 1;

FIGS. 3A–3C are cross-sectional views of three different sizes of measuring cups, which illustrate how the measured volume of product may be changed;

Figure 1A:
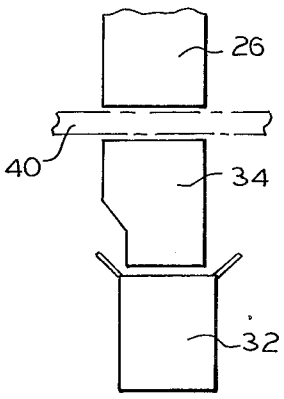
FIG. 1A is a cross section of FIG. 1 showing the relative vertical positions of the various surfaces and parts.
Figure 1:
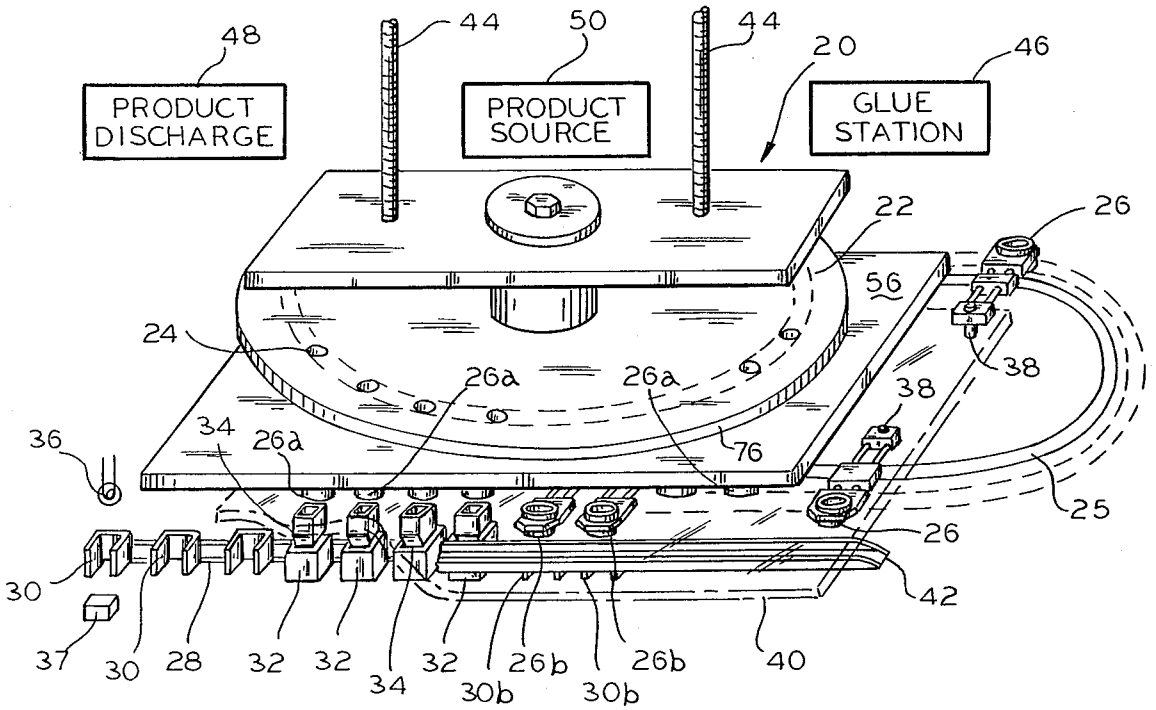
FIG. 1 is a perspective view of the inventive automatic packaging machine.
Figure 4:
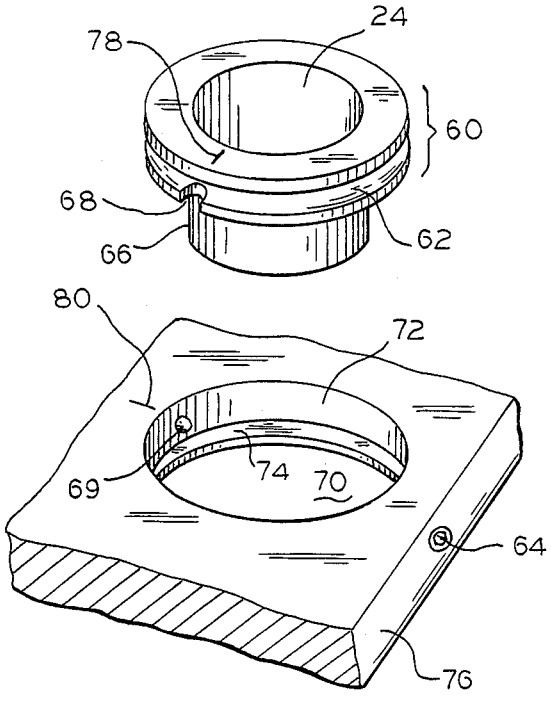
FIG. 4 is a perspective view of one of the measuring cups of FIGS. 3A–3C.

The automatic packaging machine, which incorporates the invention, is seen in FIGS. 1, 2. A superstructure 20 raises and lowers a conveyor in the form of a merry-go-round 22 for carrying a number of bottomless volumetric or measuring cups 24. An endless conveyor 25 carries a number of bottomless, wear resistant transfer cups 26 which travel under and in alignment with the measuring cups 24. A conveyor chain 28 carries a number of mandrels 30 for transporting boxes 32 past a fill station 33, in alignment with the traveling transfer cups 26. A number of funnels or chutes 34 are carried by the conveyor 25 to guide and direct product falling from bottomless transfer cups 26 into boxes 32.

Any suitable sensor 36, 37 detects the presence of a mandrel 30 which does not have a box 32 in it. While any suitable sensor may be used, FIG. 1 shows a lamp 36 and a photocell detector 37 positioned so that a box in a mandrel interrupts the light of lamp 36 falling on the detector. When a box is missing, a cam pin 38 is pushed down at a transfer cup position which will be in alignment with the empty mandrel 30, as it passes through the fill station. If the cam pin 38 is not pushed down, the bottomless transfer cups remain aligned (as shown at **26*a*) with the mandrels 30 and the boxes 32 which they contain. However, if the cam pin 38 is pushed down, the transfer cup moves outwardly, as shown at positions 26*b***, while it is traveling over empty mandrels 30*b*. When the transfer cup does not move out, it dumps product into a box 30. When transfer cup does move out, it does not dump into the box.

Each of the bottomless transfer cups 26 slides over a wear resistant surface 40 shown here in phantom lines (see FIG. 1 A), the surface functioning somewhat as the bottom of the transfer cup to keep the product in it. When a transfer cup is traveling in its normal path over an empty box, it encounters an interruption in the surface 40 so that the product falls from the transfer cup and into the box. However, if the transfer cup is pushed out (as at 26*b*), it does not pass over the interruption in surface 40 at a point where the product may pass into a box 32. Instead, the pushed out cup 26*b* passes over a second interruption in surface 40 which causes the product to drop into a discharge chute 42 from which it may be reclaimed and recycled to measuring cup 24.

The remaining parts of FIG. 1 are jack screws 44, 44 which may raise or lower the merry-go-round 22 to accommodate various sizes of measuring cups. A glue station 46 seals the boxes after they are filled. Any suitable product discharge device 48, such as a conveyor, may pick up the boxes after they are filled and sealed. A product source may be provided in the form of a suitable funnel, chute, or the like, 50 for filling the measuring cups 24 on the merry-go-round 22.

FIG. 2 looks down on the top of FIG. 1 and shows two magazines 52, 52 for storing blanks which are picked up by suction cup feeders 54, 54 that press the blanks into the mandrels 30, forming them into boxes, in the process.

The details of the inventive machine are shown in the remainder of the drawings (FIGS. 3–7).

In greater detail, FIGS. 3A–3C show three different and exemplary sizes of measuring cups which are here shown as having volumes approximately in the order of 1, 1.5, and 3.5 oz, respectively. It will be noted that each measuring cup 24 is a bottomless cup which slides along a surface 56, which functions as the bottom for containing the product therein. An interruption in the surface of transfer plate 56 allows the product to fall from measuring cup 24 and into an underlying box.

Each of the measuring cups 24 has the same diameter so that all sizes may be loaded in the same holes in merry-go-round 22; therefore the distances a, b, c between the merry-go-round and the surface of transfer plate 56 are different for each cup. The jack screws 44, 44 (FIG. 1) are driven to lift or lower the merry-go-round to the proper height a, b, c for the cups when they are put into current use. Preferably, the heights are programmed into a control for driving the jack screws 44, 44 so that a worker only has to set an identification of a cup size. A free and telescoping ring 58 surrounds cups 24 and slides over the surface of transfer plate 56. Since the ring 58 is free to slide up and down or to tip slightly, and since the ring rests under gravity against surface 56, any small unevenness in the surface 56 is accommodated.

Each cup 24 (FIG. 4) has a collar 60 with a circumferential groove 62 for receiving a set screw 64. A skirt 66 depends from the collar for receiving and moving the ring 58 (FIG. 3). One side of the collar has an indentation or cut out part 68 which enables it to slip over a detent 69 which projects from the inside wall of a hole 70.

The merry-go-round 22 has a series of holes 70 arranged in a circle which is concentric to the periphery and centered on the axis about which merry-go-round turns. Each hole has a sidewall 72 shaped and sized to receive collar 60, with an accurate fit. A ledge 74 extends inwardly from the bottom of sidewall 72 to provide a seat on which the collar 60 may rest. The peripheral or outside circumferential wall 76 of the merry-go-round 22 is fairly close to the hole 76 so that set screw 64 may be loosened or tightened from a convenient location at the front of the merry-go-round. Index markings 78, 80 are provided on the surface of the merry-go-round 22 and on the top of measuring cup 24. When these marks are aligned and the measuring cup 24 is dropped into the hole 70, the indentation 68 passes over the detent 69. A ring 58 (FIG. 3) is positioned on top of surface 56 and in a location for skirt 66 of cup 24 to pass through. The underside of collar 60 sets within hole 70 and on ledge 74. The cup 24 is rotated so that detent 69 is captured within groove 62. Then, the set screw 64 is tightened to lock cup 24 in place.

To change the size of the measuring cup, each set screw 64 is loosened. Each cup 24 is rotated until marks 78, 80 are in alignment. Then, the cup may be lifted from hole 70 with the indentation 68 passing over detent 69. The jack screws 44, 44 (FIG. 1) are driven to move the merry-go-round 22 up or down to a proper distance a, b, c from the surface 56. A ring 58 (FIG. 3) having a proper height is set on top of surface 56 and under hole 70. A new size of measuring cup 24 is passed through hole 70 and ring 56, and then rotated to capture detent 69. Next, the set screw 64 is tightened.

Figure 5:
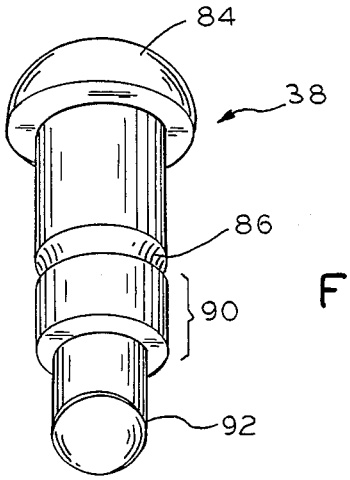
FIG. 5 is a perspective view of a cam pin used for deflecting the transfer cup when a box is not in a mandrel.
Figure 6A:
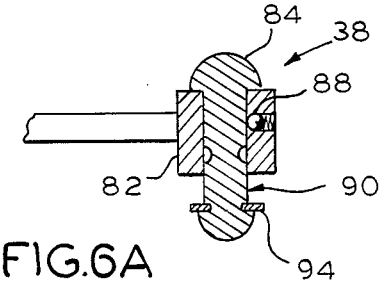
FIG. 6A is a fragment of FIG. 6 with the cam pin in a lowered position.
Figure 6:
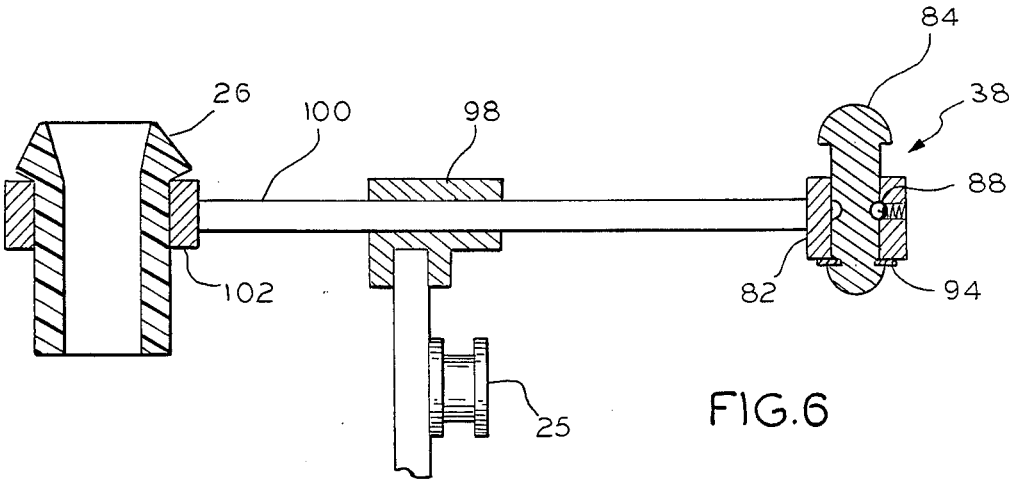
FIG. 6 is a transfer cup slide assembly controlled by the cam pin of FIG. 5, with the cam pin in an elevated position.
Figure 7:
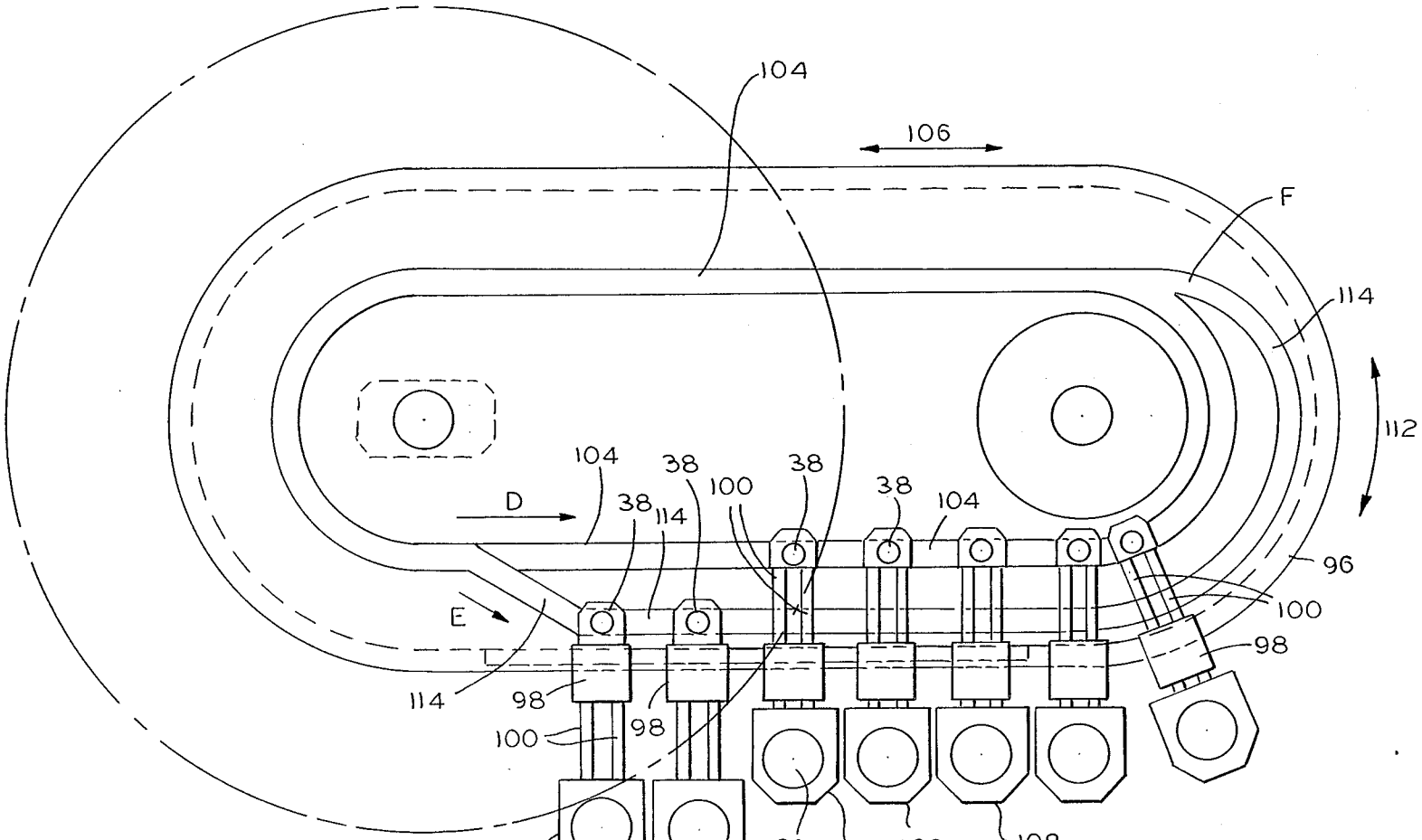
FIG. 7 is a plan view of a cam slot system for deflecting or not deflecting transfer cups under control of the cam pin and depending upon whether a box is or is not present.

FIGS. 5, 6, 7 show how a transfer cup 26 is deflected to avoid dumping product through a mandrel which does not contain a box. In greater detail, FIG. 5 shows a cam pin 38 with a two level cam which is carried by a holder block 82 (FIG. 6). The top 84 of the cam pin 38 is a dome which may or may not encounter a downward deflecting surface depending upon the presence or absence of a box 32 (FIG. 1) within a mandrel. A groove 86 normally receives a spring loaded detent 88 in holder block 82 which normally holds the cam pin 38 in an elevated position, as seen in FIG. 6. If pin 38 is lowered (FIG. 6A), a cam surface 90 on it guides the transfer cup 26 to a deflected position. In the raised position shown in FIG. 6, the cam surface 90 is substantially within holder block 82 where it cannot deflect the transfer cup. A groove 92 (FIG. 5) receives and holds a retainer ring 94 (FIG. 6) which keeps the cam pin 38 from being removed from the holder block 82.

Figure 8:
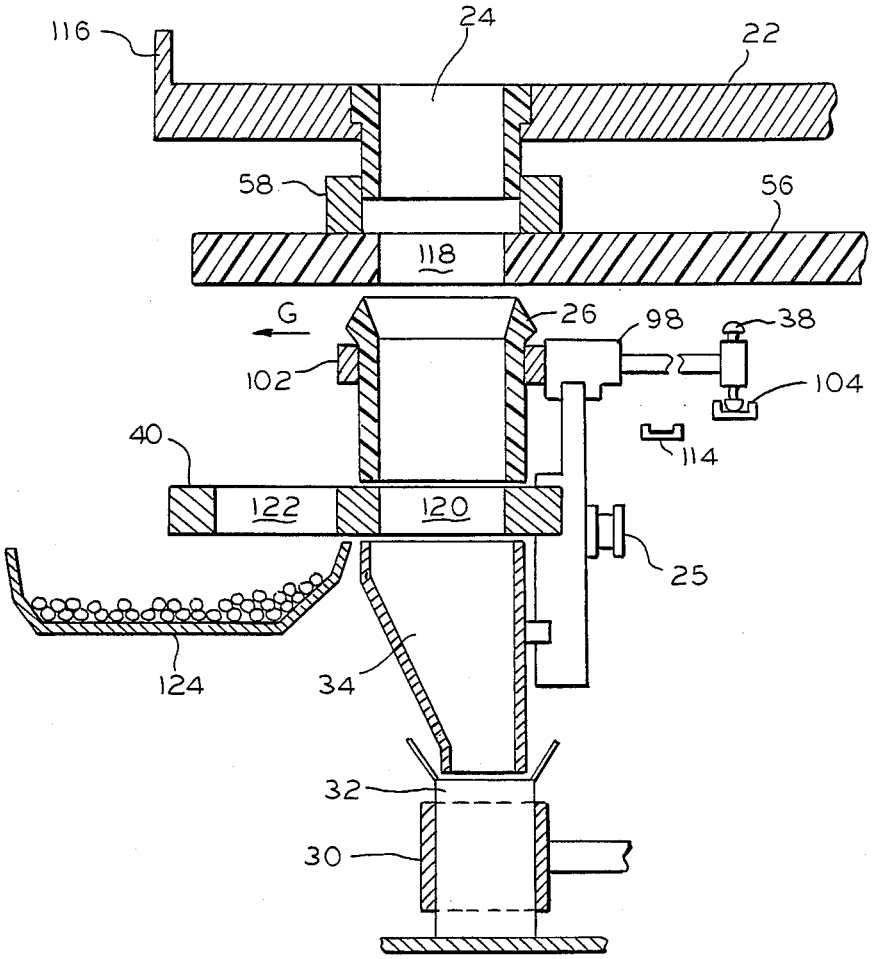
FIG. 8 is a stylized cross-sectional view of a fill station showing the principles of this invention.

The transfer cup 26 and its holder assembly are best seen in FIG. 6. A link chain 25 circles the fill station 33 (FIG. 2) and has a slide bearing 98 attached thereto in order to carry the transfer cups 26 over a path (FIG. 2) above the conveyor 28 of the boxes. Conveyor 25 also carries fill funnels or chutes 34 (FIGS. 1, 8). During part of this path, the link chain 25 normally holds transfer cups 26 under the holes 70 in merry-go-round 22 and over the fill funnels or chutes 34 and boxes 32.

A pair of rods 100 extend from cam pin holder block 82 through slide bearings 98 to a transfer cup holder 102. When cam pin 38 is elevated, it follows a first path which pulls the rods 100 to the right as viewed in FIG. 6, in order to move transfer cup 26 over the boxes. When cam pin 38 is pushed down, cam surface 90 pushes rods 100 to the left which slide through bearing 98 to deflect the transfer cup 26 to a position where it cannot fill a box.

The arrangement for accomplishing this deflection of transfer cup function is seen in FIG. 7 which has a cam slot 104 arranged in a race track pattern, that follows and parallels the link chain conveyor 25. The cam pins 38 are selectively pushed down by any suitable means in the area 106, responsive to a box missing signal from sensor 37 (FIG. 1). The particular cam pin which is so pushed down is the one which is associated with a transfer cup which will be directly over the particular mandrel with a missing box that prompted the signal from sensor 37, when that mandrel is in a position to receive product. When the cam pins 38 are in the elevated position (FIG. 6), the lower tip end follows path D (FIG. 7), which pulls rods 100 to position transfer cup holder 102 over the path followed by the mandrels 30 and boxes 32 (FIG. 1), as shown at 108. On the other hand, if the cam pin 38 is pushed down (FIG. 6A), the cam surface 90 is deflected to path E (FIG. 7) and cam slot 114. This pushes the transfer cup holder 102 outwardly (as shown at 110) where the transfer cup cannot drop product into the non-existing box 32 or the empty mandrel 30.

In the area 112, the bottom of the cam slot 114 raises the cam pin 38 so that by the time that cam slot 114 rejoins cam slot 104 at F, all cam pins 38 are in their normal raised position (as shown in FIG. 6).

The equipment for carrying out the fill cycle is schematically shown in FIG. 8, where all parts are shown in a theoretical alignment, but it should be understood that the various alignments occur in a sequential cycle and at different physical locations. The merry-go-round 22 has a raised edge 116 which keeps the product from falling off the surface. The product falls onto the top of merry-go-round 22 and then into measuring cup 24, which carries it to a first interruption or suitable opening 118 in a transfer plate 56, where it falls into transfer cup 36. Preferably the first interruption or opening 118 is an elongated slot which enables measuring cup 24 to travel in alignment over open transfer cup 26 for a period of time which is adequate for the transfer of a full measure of the maximum amount of product for the largest measuring cup that can be used. After the measuring cup 24 leaves the first interruption, or opening 118, the product cannot be dropped from the measuring cup.

Likewise, the transfer cup 26 carries the product until it comes to a second interruption or opening 120 in surface 40, at which time the product falls through chute 34 and into box 32 which is being carried by mandrel 30. Again the second interruption or surface opening 120 is a slot which is long enough to insure a complete transfer of the maximum amount of product that can be handled by the machine (i.e., the largest box which this machine can carry).

It should be understood that FIG. 8 shows openings 118 and 120 aligned, but that is only for convenience of explanation. In reality these two openings are displaced from each other by a substantial distance so that there is a three-step transfer operation (a) from measuring cup 24 through first interruption or surface opening 118 to transfer cup 26, (b) ample time to displace the transfer cup 26 in direction G if no box is present, and (c) from the transfer cup 26 to box 32 via second interruption or surface opening 120 after there has been enough time to displace cup 26, if it is to be displaced.

FIG. 8 shows the cam pin 38 following cam slot 104 so that the product is deposited through surface interruption 120 and into the box 32. However, if cam pin 38 is following cam slot 114, the transfer cup holder 102 is displaced in direction G by a distance which is far enough for the transfer cup 26 to pass over a third surface interruption 122 instead of over the second interruption 120. When transfer cup 26 passes over surface interruption 122, the product falls there through and into a collection bin 124. Any suitable means, not shown, collects the product in bin 124 and returns it to the measuring cups 24.

Those who are skilled in the art will readily perceive how to modify the invention. Therefore, the appended claims are to be construed to cover all equivalent structures which fall within the true scope and spirit of the invention.

The invention claimed is:

1. An automatic packaging machine comprising a source of product, transport means for successively moving measured volumes of product from said source toward a fill station, a plurality of transfer means also moving toward said fill station in synchronism with said transport means for receiving said measured volumes of product during the moving thereof, conveyor means moving in synchronism with said transport and transfer means for presenting a sequence of empty boxes to said fill station, said transfer means converging with said boxes at said fill station for dumping product from said transfer means into said boxes, means for sensing an absence of a box in said sequence of empty boxes on said conveyor means, and means responsive to said sensing means for diverting a particular one of said transfer means corresponding to the position in said sequence of said absent box, said diversion of said transfer means occurring before it reaches said fill station to prevent said dumping of said product into the position in said sequence where said box is absent.

2. The machine of claim 1 wherein said transport means comprises a conveyor for transporting a plurality of bottomless measuring cups past said source of product, over a supporting surface and to said transfer means; each of said measuring cups holding a predetermined volume of product which fills one of said boxes, and an opening in said supporting surface through which said product may fall from said measuring cup into said transfer cup.

3. The machine of claim 2 wherein said opening extends over a substantial distance along a path followed by said measuring cups and said transfer cup to provide sufficient time for a complete transfer of all of the product that is accumulated in the largest measuring cup that may be used on said machine.

4. The machine of claim 2 wherein said transfer means comprises a plurality of transfer cup holders mounted on a transfer conveyor for traveling over a path with each transfer cup holder moving directly beneath a corresponding moving measuring cup throughout at least part of said path which includes said opening.

5. The machine of claim 4 and a slide bearing individually associated with each of said transfer cup holders, a rod extending through said slide bearing for supporting said transfer cup holder whereby said rod may slide back and forth to displace said transfer cup holder as it is moved by said transfer conveyor, a cam pin associated with said rod for controlling the sliding of said rod and therefore the displacement or nondisplacement of said transfer cup holder, a cam slot extending along a path which corresponds to a path followed by said transfer conveyor, said cam slot branching between a normal path and a displaced path over a predetermined distance, and means responsive to said sensing means for controlling said cam pin to selectively depart from said normal path and follow said displaced path, thereby forming said diverting means.

6. The machine of claim 5 wherein said cam pin comprises a two step cam having means for normally holding said camp in on a first step, means responsive to said sensing means for moving said cam pin to a second step, means responsive to said cam pin on said first step for following said normal path and sliding said rod to a position where said cup holder converges with one of said boxes, and means responsive to said cam pin on the second step for following said displaced path and sliding said rod to a position where said cup holder is diverted away from said one box.

7. The machine of claim 6 and means responsive to said cam pin traveling in said cam slot over said predetermined distance for returning said cam pin to said normally held one step.

8. The machine of claim 5 and a bottomless transfer cup held in said cup holder, a supporting surface underlying said cup and functioning as a bottom for said transfer cup, a first interruption in said supporting surface for enabling product to fall from said transfer cup and into an underlying box as said transfer cup and box move along said normal path, and a second interruption in said supporting surface for enabling said product to fall into a recovery area as said transfer cup moves along said displaced path.

9. The machine of claim 1 wherein said transport means comprises a circular plate mounted to turn about an axis as a merry-go-round, a plurality of holes formed in said plate and centered on a circle which is concentric with said axis, and a measuring cup mounted in each of said holes.

10. The machine of claim 9 and means for securing each of said cups in an individually associated one of said holes, with access to said securing means from an edge of said plate which is exposed to view as said merry-go-round turns.

11. The machine of claim 9 wherein each of said measuring cups has a collar with a circumferential groove formed therein, each of said holes contain a detent projecting into said hole far enough to lock into said groove, an indentation in said collar for enabling said detent to enter said groove when said cup is dropped into said hole, whereby said cup may be turned to capture said detent in said groove, and a set screw extending from an edge of said plate into said groove for locking said measuring cup in said hole.

12. The machine of claim 11 and means for adjusting an elevation of said plate to accommodate measuring cups of different depth.

13. An automatic packaging machine comprising a bottomless volumetric cup for measuring a predetermined amount of product, a first produce supporting plate with a first opening therein which functions as a bottom of said volumetric cup, said first product supporting plate and said volumetric cup moving relative to each other in order to periodically present said first opening at the bottom of said volumetric cup, a bottomless transfer cup which may be positioned under said volumetric cup at a time when said first product supporting plate presents said first opening to enable a product in said volumetric cup to fall into said transfer cup, a second product supporting plate with a second opening therein, said second plate functioning as a bottom of said transfer cup, said second product supporting plate and said transfer cup moving relative to each other in order to periodically present said second opening to enable a product in said transfer cup to fall into an underlying structure, the periodic time when said second opening is presented to said transfer cup being after the periodic time when said first opening is presented to said volumetric cup, and means effective between the times when said first and second openings are presented to their respective cups for displacing said transfer cup so that it is not over said second opening if said underlying structure is not present to receive said product.

14. The machine of claim 13 and a third opening in said second product supporting plate for enabling a product in said displaced transfer cup to fall into a product recovery area.

15. The machine of claim 13 and conveyor means for causing said relative movements between said volumetric cup, transfer cup, product supporting surfaces, and underlying structure; the movements of said conveyor means following a three step time cycle of (a) transfer product from said volumetric cup to said transfer cup, (b) displace said transfer cup if said underlying structure is not present, and (c) transfer product from said transfer cup to said underlying structure if said transfer cup is not displaced.

16. The machine of claim 15 and a plurality of cam means for controlling said relative movements caused by said conveyor means, a first of said cam means being an endless cam slot which branches at two points to establish (a) a first path for causing said displacement of said transfer cup and a return thereof from said displacement and (b) a second path in which said transfer cup is not displaced, a second cam comprising a pin with two steps, and means for selectively moving said pin between said two steps while it is riding in said cam slot, a first of said two steps following said first path and a second of said two steps following said second path.

17. The machine of claim 16 wherein said cam pin normally operates on its second step, and said selective moving means operates responsive to a test for the presence of said underlying structure for selectively changing said cam pin to said first step, and means responsive to said cam slot returning from said displacement for returning said cam pin to said second step.

18. A method of transferring product through an automatic packaging machine without requiring gates to open and close a transfer path, said method comprising the steps of:

(a) simultaneously transporting a plurality of bottomless measuring cups, bottomless transfer cups, and boxes around closed paths which converge with each other at predetermined points along said paths;

(b) supporting products within said measuring cups and said transfer cups by underlying and individually associated surfaces which are interrupted at predetermined locations to allow product to fall out of said cups in order to transfer product from said measuring cups to said transfer cups and from said transfer cups to said boxes at selected locations;

(c) detecting the presence or absence of said boxes; and (d) continuously moving said cups over said surfaces in coordination with movement of said boxes to produce a three step fill sequence comprising (i) transferring product from said measuring cups to said transfer cups, (ii) selectively deflecting the path of one of said transfer cups responsive to an absence of an associated box detected in step (c) so that product is not transferred from said transfer cup while in said deflected path to the position of said absent box, and (iii) transferring product from non-deflected transfer cups into boxes which are individually associated with said transfer cups.

19. The method of claim 18 and the added step of recovering product from said transfer cup in said deflected path.

20. The method of claim 19 and the added step of returning said deflected transfer cup from said deflected path to a normal path after recovery of said product from said deflected transfer cup.

* * * * *